US005516004A

United States Patent [19]

Lane

[11] Patent Number: 5,516,004

[45] Date of Patent: May 14, 1996

[54] PRESSURE REGULATOR AND AMPLIFIER

[75] Inventor: Michael L. Lane, Arvada, Colo.

[73] Assignee: Quoin Industrial, Inc., Golden, Colo.

[21] Appl. No.: 264,449

[22] Filed: Jun. 23, 1994

[51] Int. Cl.[6] ..... G01F 11/00

[52] U.S. Cl. ..... 222/1; 222/94; 222/95; 222/130; 222/145.5; 222/386.5; 222/389; 222/394; 222/399; 222/402.18

[58] Field of Search ..... 222/1, 94, 95, 222/96, 105, 135, 136, 145.1, 145.5, 145.6, 386.5, 387, 389, 394, 397, 399, 402.18

[56] References Cited

U.S. PATENT DOCUMENTS

| | | | |
|---|---|---|---|
| 4,379,453 | 4/1983 | Baron | 222/386.5 X |
| 4,478,044 | 10/1984 | Magid | 222/386.5 X |
| 4,785,972 | 11/1988 | LeFevre | 222/386.5 X |
| 4,823,985 | 4/1989 | Grollier et al. | 222/105 X |
| 4,919,310 | 4/1990 | Young et al. | 222/386.5 |
| 4,923,095 | 5/1990 | Dorfman et al. | 222/386.5 |
| 5,021,219 | 6/1991 | Rudick et al. | 222/129.3 X |
| 5,106,597 | 4/1992 | Plester et al. | 222/325 X |
| 5,186,362 | 2/1993 | Biagi, Jr. | 222/399 X |
| 5,398,850 | 3/1995 | Sancoff et al. | 222/386.5 |

FOREIGN PATENT DOCUMENTS

| | | | |
|---|---|---|---|
| 4108586 | 9/1992 | Germany | 222/95 |

*Primary Examiner*—Joseph A. Kaufman
*Attorney, Agent, or Firm*—Kyle W. Rost

[57] ABSTRACT

A bulk container of pressure dispensable product receives a supply of gas from a plurality of containers arranged in operative series and, optionally, nested. Gas pressure is supplied by mixing at least two components of a multiple component gas generating chemical system, in which the containers in series initially house alternating ones of the gas generating chemicals. Delivery tubes connect the containers, define the series, and supply chemical from one container to the next to generate gas and regulate pressure. Pressure generation is initiated by adding the appropriate chemical or pressurized gas to at least one container, such as the container operatively furthest from the bulk container.

35 Claims, 1 Drawing Sheet

PRESSURE REGULATOR AND AMPLIFIER

CROSS REFERENCE TO RELATED APPLICATION

This application is related to co-pending U.S. Ser. No. 07/968,834, now U.S. Pat. No. 5,333,763, filed Oct. 30, 1992, and titled "Pressure Activated Trigger." This related application also is assigned to the assignee of the present application.

TECHNICAL FIELD

The invention generally relates to gas generators and associated apparatus and especially to disposable gas generator using chemical reactants. More specifically, the invention relates to a mechanical and chemical system for regulating pressure in tandem interconnected containers and amplifying such regulation over a larger volume, for use in dispensing flowable product. The invention also relates to an improved method of activating a pressure generating system used in combination with a dispensing container for flowable product. In one embodiment the dispensing container holds at least a first component of a two component gas generating system and another enclosure, either nested in the dispensing container or externally connected to it, houses a second component of the gas generating system. In another embodiment, the dispensing container holds a product to be dispensed, and two or more enclosures, either nested in the dispensing container or externally connected to it and to each other, house first and second components of the gas generating system.

BACKGROUND ART

This invention is broadly applicable to the art of dispensing, especially to dispensing flowable products or fluids of all types, specifically to dispensing multicomponent products such as two-component foam plastics. Dispensing the product with a somewhat constant rate of flow requires that the pressure within the bulk container be supplemented as the product volume decreases due to use. In some containers, this need is met by providing a means for supplying additional gas, such as air, carbon dioxide or nitrogen into the container as required. However, this requires an added pump or gas cylinder, which is expensive and wasteful and in some cases results in an uneven pressure profile.

The art contains at least one successful apparatus for pressurizing a bulk container for flowable product without requiring expensive and wasteful supplemental equipment. This art is found in U.S. Pat. No. 4,923,095 to Dorfman et al. According to the teachings of the Dorfman patent, a scaled, expandable pouch or bladder contains a two-component gas generating system, such as citric acid and bicarbonate of soda. Initially, the two components are physically isolated so that they do not generate gas. The pouch can be inserted into a beverage container, such as a keg or large bottle, and the container then can be filled with beverage and sealed. At some point in time, either shortly before inserting the pouch or at a later time, the two components of the gas generating system must be placed in mutual contact so as to generate gas to expand the pouch and thereby pressurize the container to dispense the beverage. The pouch contains a plurality of sub-compartments so that it can expand in stages. As the beverage volume progressively decreases, pressure within the pouch progressively opens new sub-compartments. Each sub-compartment contains a component of the gas generating system, with the result that as each sub-compartment is opened, more gas can be generated.

The technology of the Dorfman patent effectively solves certain problems in the dispensing industry, especially in dispensing beverages. However, unsolved problems remain in the area of dispensing products that require relatively higher pressures or that require especially uniform application of pressure. Further, Dorfman does not provide a means for supplying a gas stream for atomizing and dispensing the product.

U.S. Ser. No. 07/968,834, filed Oct. 30, 1992, and titled "Pressure Activated Trigger" discloses an improvement of the Dorfman technology, wherein a pressure-rupturable membrane separates one component of the gas generating system from the second component. The components are mixed when an externally applied pressure charge ruptures the membrane.

U.S. Pat. No. 5,106,597 to Plester et al discloses a gas generator using a two-component, acid-base system, in which the components are brought together under self-controlled conditions causing gas generation and release at a predetermined pressure. However, this system operates at artificially elevated pressures, initiated by a starting charge that drives the generating reaction. In addition, a considerable amount of mechanical regulating equipment is required.

U.S. Pat. No. 5,021,219 to Rudick et al discloses another acid-base gas generating system, in which an acid chamber is at a higher pressure than the base/reaction chamber, and a pressure regulator valve separates to two and permits acid to feed when pressure in the base/reaction chamber is lower than a set limit. This system also requires artificially elevated pressures.

It would be desirable to develop a pressure generator that stores and ships at atmospheric pressure and without complex or expensive mechanical valves and pressure regulators.

Similarly, it would be desirable to have a simple and inexpensive chemical and mechanical system for amplifying small changes in pressure to regulate the pressure in a larger volume.

To achieve the foregoing and other objects and in accordance with the purpose of the present invention, as embodied and broadly described herein, the pressure regulator and amplifier and method of operation of this invention may comprise the following.

DISCLOSURE OF INVENTION

The invention is a pressure regulator and amplifier that is intended for use in combination with a dispensing container for flowable product. The invention employs a sealed, first container defining a first internal volume that houses a first reservoir containing at least one gas generating chemical of an at least two-component gas generating system. Over the first reservoir, the container defines a first headspace. A first delivery tube is carried in the first container, and a first end of this first tube is in external communication of the first container. The second end of this first tube is in communication with the first internal volume. A first pressure-rupturable membrane closes the first delivery tube.

According to a further aspect of the invention, the pressure regulating and amplifying system provides a bulk container that holds and dispenses a flowable product that initially is contained in one or more flexible pouches. In a first reservoir within the bulk container is a pool of a first gas generating chemical. A first headspace is located over the pool of chemical. A sealed sub-container is located within the bulk container, and the sealed container defines within it a second reservoir that houses a pool of a second gas generating chemical and defines over the chemical pool a second headspace. A delivery tube is carried in the sub-container, and a first end of the tube is in external communication of the sub-container with the first headspace volume of the bulk container. The second end of the tube is in communication with the chemical in the second reservoir. A pressure-rupturable membrane closes the delivery tube.

According to another aspect of the same invention, a pressure regulating and amplifying system further provides a nested, sealed, container located within the sub-container, wherein the nested container defines within it a third reservoir containing a volume of a first gas generating chemical of the at least two-component gas generating system and defines over the chemical in the third reservoir a third headspace. A second delivery tube is carried in the nested container, wherein a first end of the second tube is in external communication of the nested container with the interior second headspace volume of the sub-container, and the second end of the second tube is in communication with the chemical within the third reservoir. A second pressure-rupturable membrane closes the second delivery tube.

Additional advantages and novel features of the invention shall be set forth in part in the description that follows, and in part will become apparent to those skilled in the art upon examination of the following or may be learned by the practice of the invention. The advantages of the invention may be realized and attained by means of the instrumentalities and in combinations particularly pointed out in the appended claims.

The accompanying drawings, which are incorporated in and form a part of the specification illustrate preferred embodiments of the present invention, and together with the description, serve to explain the principles of the invention. In the drawings:

BEST MODE FOR CARRYING OUT THE INVENTION

The present invention provides a chemical and mechanical apparatus and method for pressurizing a bulk product dispensing container and thereafter regulating the pressure in that container. In addition, the apparatus and method anticipate that certain flowable products are dispensed with the aid of both pressure and a gas stream, wherein the pressure pushes the product from its dispensing container, and the gas stream can be of further benefit by propelling or atomizing the product as a further part of the dispensing process. The chemical aspects of the invention are known in a general way: a two-component gas generating system is employed within a dispensing container for flowable product. For example, citric acid can be mixed with potassium carbonate to generate a gas. The second aspect of the invention is a chemical and mechanical system and method of operation by which the gas generating system is actuated and thereafter controlled.

Figure 1:
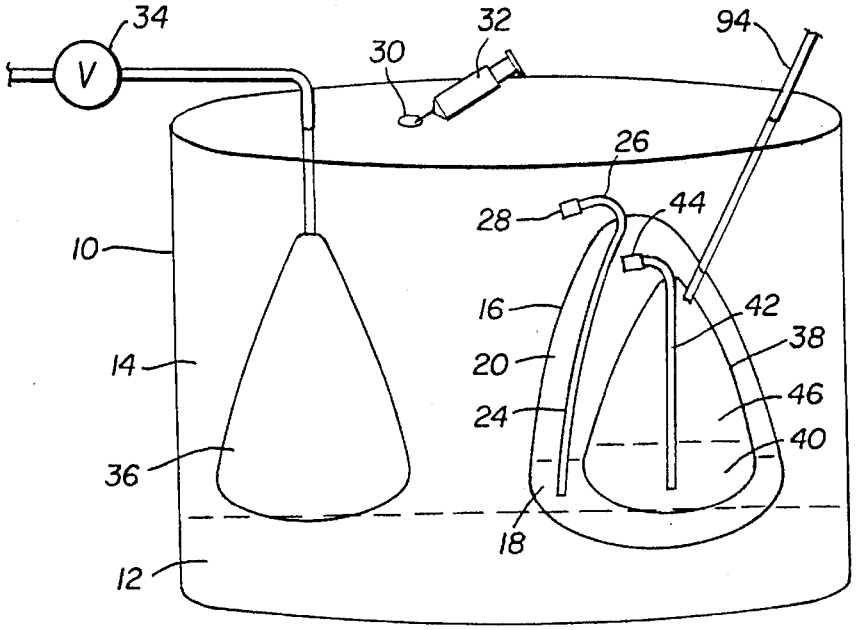
FIG. 1 is a schematic view of a first embodiment of the invention.

FIG. 1 shows the general arrangement of a sealed, at least semi-rigid bulk product dispensing container 10 employing the pressure regulating system by use of nested containers. In this example, a portion of the bulk container 10 serves to house one of the chemical compartments. The volume within the bulk container defines, in part, a first reservoir 12, and a portion of this volume directly holds a pool of one gas generating chemical, for example, citric acid. The volume within the bulk container also defines a first headspace 14 above the first reservoir portion occupied by the chemical pool.

A sub-compartment, sub-container or chemical container 16 is located within the bulk container 10 and initially is sealed. This chemical container defines a second volume housing a second reservoir containing a predetermined relative volume of a second gas generating chemical 18, for example, potassium carbonate. In addition, this container defines a predetermined relative volume of headspace 20 in the second container above the reservoir and the contained chemical. This apparatus is capable of both generating and regulating gas pressure within the bulk container 10.

While it is desirable that the bulk container 10 be at least semi-rigid, it is not necessary that any containers be semi-rigid. Thus, sub-container 16 may be a sealed, flexible pouch or a semi-rigid container. Contained within sub-container 16 is a delivery tube 24 having one end, such as the upper end, communicating externally of sub-container 16. For example, the upper, external end 26 defines an orifice communicating with the interior headspace volume 14 of bulk container 10 through the bore of the tube. Tube 24 extends downwardly into sub-container 16 to near the bottom of the container's volume, where the lower end of tube 24 is in the second reservoir 18 of second chemical. Delivery tube 24 initially is sealed, such as by a plastic membrane 28 having a predetermined rupture pressure. Membrane 28 is preferred to be applied over tube end 26, sealing the external office of the tube. The predetermined rupture pressure of membrane 28 is below the desired operating pressure of the bulk container 10 and may be, for example, 20 psig. In the embodiment as thus far stated, the initial predetermined relative volume of second chemical in the reservoir 18 of sub-container 16 is about 25% of the total volume of sub-container 16. If sub-container 16 is a flexible pouch, total volume refers to volume of the sub-container when pressurized. Correspondingly, the initial predetermined relative volume of the headspace 20 in this sub-container is about 75%.

In initial operation, the bulk container and all of its contained sub-containers, for purposes of storage and shipment, are at atmospheric pressure. If the bulk container and all of the sub-containers are of at least semi-rigid construction, the pressure generating system can be triggered by the addition of an added chemical agent in sufficient volume to cause the bulk container to reach its desired operating pressure, which may be about 70 psig. For example, through an external communication means such as an injection port, valve, dispenser or injection membrane 30, an injection means 32 can add a volume of second gas generating chemical to the bulk container 10, where it comes into reactive contact with the chemical pool in reservoir 12. In response to this addition, gas pressure within the bulk container 10 increases, rupturing membrane 28 when pressure exceeds 20 psig. The interior of sub-container 16 thereafter is in communication with the headspace 14 of bulk container 10 via delivery tube 24. Gas flows via the tube 24 from bulk container 10 into sub-container 16 until gas pressure is equalized.

The dispensable contents of bulk container 10 thereafter may be dispensed by whatever means are provided, such as through a valve 34. These contents may be located in sealed flexible pouches 36 within the bulk container and in direct contact with valve 34, with the result that the propellant gas and chemical pool in first reservoir 12 are not lost during the dispensing process. With decreasing volume of dispensable contents in the bulk container 10, gas pressure locally will decrease. With each increment of lowered gas pressure in the bulk container, a pressure differential is created between the bulk container and the sub-container 16. The then-greater gas pressure in the headspace 20 of the sub-container will drive second chemical from second reservoir 18 through delivery tube 24 into the bulk container. As a consequence, second chemical from second reservoir 18 will react with the first chemical pool in reservoir 12 to increase gas pressure in the bulk container until pressure equilibrium is achieved between containers 10 and 16.

Through usage and due to corresponding increasing headspace volume in sub-container 16, the equilibrium pressure will be slightly decreasing relative to the original operating pressure of the bulk container. For this reason, the headspace volume is relatively large in sub-container 16, i.e., 75%. A slight increase in this relatively large proportion of the overall available volume in sub-container 16 will lead of relatively small decreases in equilibrium pressure. By the use of a nested container 38, described below, the equilibrium pressure is further prevented from substantial decreases.

Another aspect of the invention is the addition of a nested compartment or container 38, sealed within sub-container 16. As in the case of sub-container 16, nested container 38 may be either a flexible pouch or an at least semi-rigid container. In function and structure, nested container 38 can be a reproduction in miniature of sub-container 16 with the exception that it defines a third reservoir 40 housing a predetermined volume of the first gas-generating chemical, i.e., citric acid, instead of the second chemical. The invention contemplates the use of a plurality of similar containers nested in sequence from first to final, to amplify the performance of the invention.

Nested container 38 is provided with an internal delivery tube 42 identical in structure and function with tube 24, with its lower end near the bottom of the supply of first chemical in the third reservoir 40. This tube initially is sealed by membrane 44 having a slightly greater rupture pressure than membrane 28 but still below the desired operating pressure of the bulk container. As a result, rupture of these two membranes 10 will be sequential. For example, membrane 44 may rupture at 30 psig.

When one or more nested containers 38 are employed, and the containers 16 and 38 are at least semi-rigid, the operation of the system is similar to that previously described. The nested container initially is filled as described for sub-container 16: about 25% chemical and 75% headspace. When the bulk container is brought to initial operating pressure, membrane 28 ruptures and is followed by rupture of membrane 44. Pressure equalization is achieved in all of the multiple container volumes: a third headspace 46 inside nested container 38 over third chemical reservoir 40 equalizes in pressure with headspaces of both sub-container 16 and bulk container 10. Subsequently, as the pressure in bulk container 10 decreases, pressure equilibrium continues to be achieved among those multiple headspace volumes. As a result, the first chemical from reservoir 40 is delivered via tube 42 to second chemical reservoir 18, where additional gas is generated until the pressure in headspace 20 is equal to the pressure in headspace 46. Correspondingly, chemical from second reservoir 18 is delivered to first reservoir 12, generating gas until the pressure in bulk container 10 is equal to the pressure in headspaces 20 and 46.

An advantage of using nested container 38 is that the sub-container 16 can be filled with a relatively greater volume of chemical. For example, chemical reservoir 18 initially may occupy 75% of the container volume, as contrasted to 25% when nested container 38 is not in use. The higher chemical content of sub-container 16 allows delivery of substantially more dispensable product from container 10.

If the multiple inner containers, such as containers 16 and 38, are flexible pouches, triggering the pressure generating system takes place at the final, innermost pouch. For this purpose, the innermost pouch 38 carries an external communication means for supplying activating pressure, either by supplying pressurized gas or by supplying a pressure generating chemical into the pouch. Suitable communication means include, for example, a valve, port, or activator tube 94 communicating with the interior of pouch 38 from the exterior of bulk container 10. The system can be activated by adding either compressed gas or second chemical through tube 94, raising the internal pressure of pouch 38 sufficiently to rupture membrane 44 and force a quantity of first chemical into pouch 16. As a result, pressure is generated in pouch 16, rupturing membrane 28 and forcing second chemical into bulk container 10, generating pressure in the bulk container. Regardless of which end of the system is initiated, when pressure is created or added to the pressure generating system it must be sufficient to rupture the membranes by the time the system reaches equilibrium. Thereafter the system will maintain equilibrium among the multiple containers by drawing pressure generating chemical from the inner containers as pressure is depleted from the outer, bulk container.

EXAMPLE 1

A flexible pouch that has a capacity of about six liters contains 1.5 liters of a base chemical, in this case a 50% solution of potassium carbonate and water. The pouch is placed into a ten liter bottle that contains 2 liters of 50% citric acid and water. The pouch has two openings: a first, valved opening is in communication with the exterior of the ten liter bottle, and a second opening carries a dip tube having one end in the base liquid and the other end open to the headspace of the ten liter bottle. The device is activated by adding compressed gas or an acid solution into the pouch through the first opening. Gas expands the pouch to its full volume and the gas then starts forcing the base chemical through the dip tube, where subsequently it mixes with the citric acid to produce gas. As gas is added to or generated in the pouch, the entire system is boosted to operating reference pressure. In operation, as gas is drawn out of the ten liter bottle, the fixed volume of gas in the pouch forces base chemical through the dip tube, where it mixes with the citric acid and maintains system pressure. This configuration was activated to 70 psi with 450 ml of citric acid added to the pouch. The system generated a gas stream until the chemicals were spent and ended up at a final pressure of 50 psi.

Figure 2:
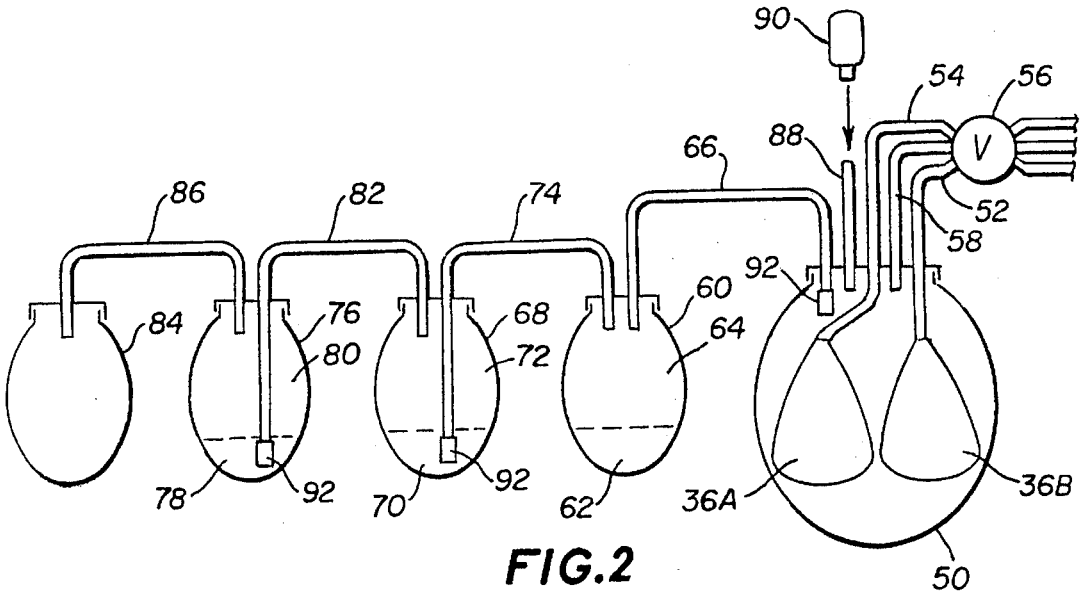
FIG. 2 is a schematic view of a second embodiment thereof.

A fully equivalent and equally functional dispensing system may be constructed of serially interconnected, juxtaposed, but non-nested containers, or a combination of nested and non-nested containers. With reference to FIG. 2, the pressure regulator and amplifier is shown in an embodiment with each function separated into a separate container.

For example, a product container 50 may have a volume of about ten liters, occupied by product pouches and pressurized gas. Flowable material to be dispensed is carried in two sealed, flexible pouches 36A and 36B. Any other number of pouches could be used, depending upon the requirements of the product. However, this example anticipates that the product could be a two component foam, and each component is in a separate one of the two illustrated pouches. Separate product tubes 52 and 54 connect each pouch to a dispensing valve 56, which operates simultaneously on both tubes to dispense the products under pressure into a mixing and spraying gun. A third tube 58 may supply some of the pressurized gas from container 50 to the valve 56 for use in atomizing the product as a further part of the dispensing, mixing or spraying process. The valve 56 may operate on the gas tube, as well. In this example, it is not required that the product container 50 also serve as a reservoir for any of the gas generating chemicals, although such additional function is permissible.

Gas pressure is supplied and regulated by a plurality of interconnected chemical containers. The number and size of such containers can be selected to accommodate the particular application, with consideration of the sustained pressure that is required and of the volume to be dispensed. As one example, a first chemical container 60, having a volume of three liters, defines a first reservoir 62 housing a predetermined volume of the first chemical, citric acid. Over the chemical pool within reservoir 62 is a first headspace 64. A gas tube 66 connects the headspace 64 externally of container 60, such as to the interior of product container 50 for delivering pressure and a gas stream, and equalizing pressure between the product container and the first chemical container.

A second chemical container 68, also having a volume of three liters, defines a contained second reservoir 70 housing a pool of predetermined volume of the second chemical, potassium carbonate. Over the chemical pool within the reservoir 70 is defined a second headspace 72. A first chemical delivery tube 74 connects the reservoir 70 externally of container 68, for example to the headspace 64 of the first chemical container. The pick-up end of tube 74 is near the bottom of the chemical pool in reservoir 70 so that it can pick-up substantially all of chemical for delivery to the first chemical container. Tube 74 both delivers second chemical to container 60 and provides a return passageway for equalizing pressure between the respective headspaces of container 60 and container 68.

A third chemical container 76, also having a volume of three liters, defines a contained third reservoir 78 housing a pool of the first chemical. Over the chemical pool in reservoir 78 is a third headspace 80. A second chemical delivery tube 82 connects the reservoir 78 externally of container 76, for example to the headspace 72 of the second chemical container. The pick-up end of tube 82 is near the bottom of the chemical pool in reservoir 78 so that it can pick-up substantially all of chemical for delivery to the second chemical container. Tube 82 delivers first chemical to container 68 and provides a return passageway for equalizing pressure between the respective headspaces of container 68 and container 76.

A sequence of additional similar chemical containers, with alternating first or second chemical contents, can be expanded as required following the example of containers 68 and 76. The system of three chemical containers, as described above, has been tested using 500 ml of 50% solution of citric acid in container 76, 1500 ml of 50% potassium carbonate in container 68, and 1500 ml of 50% citric acid in container 60. The system was activated using a compressed air source to bring container 60 to 75 psig. Pressure was discharged from container 60 at a rate suitable for spraying a two component foam. The system produced pressure at +70 psig for at least fifteen minutes.

The system can be activated by any of several means. First, chemical means can be added to one or more of the chemical containers for generating initial pressure by the same or similar reaction used throughout the system. However, such chemical initiation has the disadvantage of using up some of the reagents and reducing the length of operating time. One way of employing chemical activation is by adding an initiator bottle 84, containing one of the chemicals. This bottle is connected by tube 86 to at least one of the containers, such as container 76 containing the other gas generating chemical. When it is desired to activate the system, bottle 84 is inverted over container 76, pouring the chemical from bottle 84 into the chemical within reservoir 78, thereby generating gas pressure in container 76 and initiating gas production throughout the system. Another way to chemically activate this system is by adding an activating chemical through an external communication means such as an injection port, valve, dispenser, or injection membrane 30, using an injection means 32 similar to that previously described and shown in FIG. 1. The external communication means can be located on any of the several containers, although it is preferred to chemically activate the system from the last container in the sequence.

A second way of activating the system is by an external pressure supply means, using an external source of gas pressure for raising the headspace pressures to the desired operating pressure. This system has the advantage of not consuming the reagents in the chemical containers. External pressure can be added through an external communication means such as activator tube 88, which may include a suitable valve, to product container 50, chemical container 60, or one of the other chemical containers. The system will reach equilibrium regardless of where the pressure is added, although adding the pressure to the final container 76 is desirable. A convenient source of external pressure is a disposable gas cartridge, such as a $CO_2$ cartridge 90, or other pressure vessel. Pressure added to containers 50 or 60 would bring the entire system into equilibrium at elevated pressure such as 75 psig. Pressurized gas would flow in reverse through tube 74 from container 60 into container 68. Similarly, pressurized gas would flow in reverse through tube 82 from container 68 to container 76. Pressure between containers 50 and 60 is equalized through tube 66 in whichever direction is appropriate.

In order to prevent accidental activation of this system during handling and shipment, the delivery tubes 74 and 82 may have their pick-up ends covered by a pressure-rupturable plastic membrane 92. Such a membranes prevents passage of chemical from one container to the next, thereby preventing accidental generation of pressure. The gas delivery tube 66 also may have an end covered by membrane 92 to prevent loss of chemical into the product container. However, the addition of activation pressure, such as from a gas cartridge 90, ruptures the membranes 92 and allows the system to operate by passing chemicals and pressure through the tubes in the way described previously.

The pressure regulator and amplifier have been described in at least two distinct embodiments. The first employed nested chemical containers using internal connections, while the second employed independent chemical containers using external connections. These two examples demonstrate a scope that includes many intermediates, such as a combination of nested and independent containers, or multi-cell containers with internal or external connections. Further, the bulk container also may serve as one of the chemical containers in any of the prior embodiments and have a portion of the pressurized gas generated within it. In the alternative, in any of the prior embodiments, the bulk container may house only dispensable product and receive pressurized gas from separate chemical containers connected to or housed within the bulk container.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention as defined by the claims that follow.

I claim:

1. A pressure regulator and amplifier, for use in combination with a dispensing container for flowable product, comprising:

a sealed first container having a first internal volume, housing a first reservoir of at least one gas generating chemical of an at least two-component gas generating system and defining over said first reservoir a first headspace;

a first delivery tube carried in said first container, wherein a first end of said first delivery tube is in external communication of the first container and the second end of said first delivery tube communicates with said first internal volume of the first container;

a sealed second container having a second internal volume, housing a second reservoir of at least the second gas generating chemical of the at least two-component gas generating system, wherein at least said second chemical is liquid, and defining over said second reservoir a second headspace; and a second delivery tube carried in said second container, wherein a first end of said second delivery tube is in communication with the first internal volume of said first container, and the second end of said second delivery tube is in communication with said second gas generating chemical in said second reservoir, creating a liquid lock between the second headspace and the first internal volume.

2. The pressure regulator and amplifier of claim 1, wherein:

the second end of said first delivery tube is in communication with said first headspace, and the first end of the first delivery tube is connectable for communication, in use, with a dispensing container.

3. The pressure regulator and amplifier of claim 1, further comprising:

a first pressure-rupturable membrane closing said first delivery tube; and a means for supplying activating pressure to said first container in quantity sufficient to rupture said first membrane.

4. The pressure regulator and amplifier of claim 3, wherein said means for supplying activating pressure further comprises:

an external communication means for admitting activating pressure to said first container, sufficient to rupture said first membrane.

5. The pressure regulator and amplifier of claim 4, wherein said external communication means is carried by said first container.

6. The pressure regulator and amplifier of claim 4, wherein said external communication means is in communication with said first container through said second delivery tube.

7. The pressure regulator and amplifier of claim 1, wherein the first end of the second delivery tube is in communication with the first headspace of said first container.

8. The pressure regulator and amplifier of claim 1, further comprising: a second pressure-rupturable membrane closing said second delivery tube.

9. The pressure regulator and amplifier of claim 8, further comprising:

a means for supplying activating pressure to said second container in quantity sufficient to rupture said second membrane.

10. The pressure regulator and amplifier of claim 9, wherein said means for supplying activating pressure further comprises:

an external communication means for admitting activating pressure to said second container, sufficient to rupture said second membrane.

11. The pressure regulator and amplifier of claim 1, further comprising:

a sealed third container having a third internal volume, housing a third reservoir containing at least said first gas generating chemical of the at least two-component gas generating system, wherein the first gas generating chemical is a liquid, and defining over said third reservoir a third headspace;

a third delivery tube carried in said third container, wherein a first end of said third delivery tube is in communication with the interior volume of said second container, and a second end of the third delivery tube is in communication with the first gas generating chemical in the third reservoir, creating a liquid lock between the third headspace and the second internal volume.

12. The pressure regulator and amplifier of claim 11, wherein the first end of the third delivery tube is in communication with the second headspace of said second container.

13. The pressure regulator and amplifier of claim 11, further comprising:

a third pressure-rupturable membrane closing said third delivery tube.

14. The pressure regulating and amplifying system of claim 13, further comprising:

a means for supplying activating pressure to said third container in quantity sufficient to rupture said membrane.

15. The pressure regulator and amplifier of claim 14, wherein said means for supplying activating pressure further comprises:

an external communication means for admitting activating pressure to said third container, sufficient to rupture said membrane.

16. The pressure regulator and amplifier of claim 11, wherein said third container is nested within said second container, further comprising:

an external communication means for admitting activating pressure to said third container, directly communicating with said third internal volume from outside said second container.

17. The pressure regulator and amplifier of claim 1, wherein said second container is nested within said first container, further comprising:

an external communication means for admitting activating pressure to said second container, directly communicating with said second internal volume from outside said first container.

18. The pressure regulator and amplifier of claim 1, wherein:

the dispensing container comprises a bulk container means for holding and dispensing a flowable product, carrying a pressure-deformable vessel of flowable product within the bulk container means; and the first end of said first delivery tube is in communication with said bulk container means.

19. The pressure regulator and amplifier of claim 18, wherein said first container is nested within said bulk container means, externally of the pressure deformable vessel.

20. The pressure regulator and amplifier of claim 19, wherein:

said second container is located within said first container; and the first end of said second delivery tube is in communication with said first headspace of said first container.

21. The pressure regulator and amplifier of claim 18, further comprising:

a third sealed container, located within said second container, defining a third internal volume, housing a third reservoir of said first gas generating chemical of the at least two-component gas generating system, wherein the first gas generating chemical is a liquid, and defining over said third reservoir a third headspace;

a third delivery tube carried in said third container, wherein a first end of said third delivery tube is in communication with said second headspace of said second container, and a second end of the third delivery tube is in communication with the first gas generating chemical in the third reservoir, creating a liquid lock between said third headspace and the second headspace.

22. The pressure regulator and amplifier of claim 18, wherein said first container is juxtaposed to said bulk container means, externally thereof; and said first delivery tube is in communication with the interior of the bulk container means, outside said pressure-deformable vessel.

23. A pressure regulating and amplifying system, for use in dispensing flowable product, comprising:

a bulk container means for holding and dispensing a flowable product, housing a pressure-deformable vessel of flowable product within the bulk container means;

a first sealed chemical container defining a first internal volume that contains a first reservoir of a first gas generating chemical of an at least two-component gas generating system and defining over said reservoir a first headspace;

a first delivery tube carried in said first chemical container, wherein a first end of said first delivery tube is in communication with the interior of said bulk container means, external of said vessel, and the second end of said first delivery tube is in communication with said first reservoir;

wherein, outside the vessel, said bulk container means houses a reservoir of a second gas generating chemical of the at least two-component gas generating system, and defines a headspace over the reservoir.

24. The pressure regulating and amplifying system of claim 23, wherein said first chemical container is nested within said bulk container means, externally of the pressure deformable vessel.

25. The pressure regulating and amplifying system of claim 23, wherein said first chemical container is juxtaposed to said bulk container means, externally thereof.

26. The pressure regulating and amplifying system of claim 25, further comprising:

a second sealed chemical container, juxtaposed to said first chemical container, defining a second internal volume, housing a second reservoir containing the second gas generating chemical of the at least two-component gas generating system and defining over said second reservoir a second headspace;

a second delivery tube carried in said second chemical container, wherein a first end of said second delivery tube is in communication with the first headspace of said first chemical container, and the second end of the second delivery tube is in communication with said second reservoir.

27. A pressure regulating and amplifying system, for use in dispensing flowable product, comprising:

a plurality of nested pressure containers ranging from an outermost container to an innermost container;

means connecting said containers in sequence for transmitting pressurized fluid between the containers;

a pressure deformable vessel carrying flowable product, located in said outermost container, and having an external dispensing means for selectively discharging the flowable product from the vessel and from the outermost container;

wherein at least two of said pressure containers each hold a reservoir of a different one of first and second gas generating chemicals that generate gas when mixed;

activating means for causing an increase of gas pressure in said container holding said first gas generating chemical, sufficient to transmit a portion of the first chemical through said connecting means into the container holding said second gas generating chemical.

28. The pressure regulating and amplifying system of claim 27, further comprising:

pressure-rupturable membrane means for sealing said connecting means against flow of said gas generating chemicals;

wherein said activating means produces a sufficient increase of gas pressure to rupture said membrane means.

29. The pressure regulating and amplifying system of claim 27, wherein said dispensing means comprises:

a product discharge tube having an intake end communicating with said pressure deformable vessel and receiving flowable product, and having a discharge end in external communication of said outermost container;

wherein, in use, when pressure in the outermost container increases, pressure in the vessel increases under pressure deformation thereof, and in response to the pressure increase, said product discharge tube discharges flowable product under pressure.

30. The pressure regulating and amplifying system of claim 29, wherein said dispensing means further comprises:

a gas discharge tube having an intake end communicating with at least one of said pressure containers and receiving pressurized gas, and having a discharge end in external communication of said outermost container and in general proximity to said discharge end of said product discharge tube, discharging pressurized gas and fluidizing said stream of flowable product.

31. A pressure regulating and amplifying system, for use in dispensing flowable product, comprising:

a plurality of juxtaposed pressure containers;

means serially interconnecting said containers for transmitting pressurized fluid between the containers;

a pressure deformable vessel carrying flowable product, located in an end container, and having a selectively operable, external dispensing means for selectively discharging the flowable product from the vessel externally of the end container;

wherein at least two of said pressure containers each house a reservoir of a different one of first and second gas generating chemicals that generate gas when mixed, wherein at least said first gas generating chemical is liquid, and wherein said interconnecting means and first chemical are in communication within said reservoir of first chemical and form a liquid lock, blocking transmittal of pressurized fluid to said pressure container housing the second gas generating chemical except with transmittal of first chemical; and activating means for causing an increase of gas pressure in said container holding the first gas generating chemical, sufficient to transmit a portion of the first chemical through the interconnecting means into the container holding said second gas generating chemical.

32. The pressure regulating and amplifying system of claim 31, further comprising:

pressure-rupturable membrane means for sealing said connecting means against flow of said gas generating chemicals;

wherein said activating means produces a sufficient increase of gas pressure to rupture said membrane means.

33. The pressure regulating and amplifying system of claim 31, wherein said dispensing means comprises:

a product discharge tube having an intake end communicating with said vessel and receiving flowable product, and having a discharge end in external communication of said end container;

wherein, in use, when pressure in the end container increases, pressure in the vessel increases under pressure deformation thereof, and in response the pressure increase, said product discharge tube discharges flowable product under pressure.

34. The pressure regulating and amplifying system of claim 33, wherein said dispensing means further comprises:

a gas discharge tube having an intake end communicating with at least one of said pressure containers and receiving pressurized gas, and having a discharge end in external communication of said end container and in general proximity to said discharge end of said product discharge tube, discharging pressurized gas and fluidizing said stream of flowable product.

35. A method of dispensing a flowable product, comprising:

providing a pressure container;

locating a flowable product within a flexible, pressure-deformable vessel;

locating said vessel within said pressure container;

providing a product discharge tube connected at its take-up end to the vessel and connected at its discharge end externally of the vessel and pressure container;

providing a gas discharge tube connected at its take-up end to the pressure container and connected at its discharge end near the discharge end of said product discharge tube;

creating pressure within said pressure container by mixing within the pressure container a plurality of chemicals of the type that produce gas when mixed;

discharging flowable product from said product discharge tube under pressure from within the pressure container;

fluidizing the discharge of flowable product by discharging gas from said gas discharge tube from the pressure container.

* * * * *